US009957729B2

(12) United States Patent
Beck et al.

(10) Patent No.: US 9,957,729 B2
(45) Date of Patent: May 1, 2018

(54) WOOD SUPPORT PROTECTION DEVICE

(71) Applicants: David Beck, Culver, OR (US); Margaret A. Beck, Culver, OR (US)

(72) Inventors: David Beck, Culver, OR (US); Margaret A. Beck, Culver, OR (US)

( * ) Notice: Subject to any disclaimer, the term of this patent is extended or adjusted under 35 U.S.C. 154(b) by 0 days. days.

(21) Appl. No.: 15/248,280

(22) Filed: Aug. 26, 2016

(65) Prior Publication Data

US 2018/0058089 A1 Mar. 1, 2018

(51) Int. Cl.

| | |
|---|---|
| ***E02D 27/42*** | (2006.01) |
| ***E04H 17/22*** | (2006.01) |
| ***A47B 91/00*** | (2006.01) |
| ***F16M 13/00*** | (2006.01) |
| ***E02D 19/00*** | (2006.01) |
| ***E04H 12/00*** | (2006.01) |
| ***E04H 12/22*** | (2006.01) |
| ***E04H 12/04*** | (2006.01) |

(52) U.S. Cl.

CPC ..... *E04H 12/2292* (2013.01); *E04H 12/04* (2013.01); *E04H 12/2238* (2013.01); *E02D 19/00* (2013.01); *E04H 12/2261* (2013.01); *E04H 12/2284* (2013.01)

(58) Field of Classification Search

CPC . E04H 12/2292; E04H 12/04; E04H 12/2238; E04H 12/2261; E04H 12/2284; E02D 19/00; E02D 27/42

USPC .... 248/519, 156, 346.5, 523, 219.2; 256/22, 256/24, 26; 52/736.4, 737.3, 738.1, 296, 52/298

See application file for complete search history.

(56) References Cited

U.S. PATENT DOCUMENTS

| | | | | |
|---|---|---|---|---|
| 4,932,174 | A | 6/1990 | Anderson | |
| 4,972,642 | A | 11/1990 | Strobl, Jr. | |
| 5,309,670 | A | 5/1994 | Bates | |
| 5,364,076 | A * | 11/1994 | Nicholls | E04H 17/1421 256/22 |
| 5,901,525 | A * | 5/1999 | Doeringer | E02D 27/42 248/519 |
| D440,326 | S | 4/2001 | Kohlberger et al. | |
| 6,244,581 | B1 | 6/2001 | Arnhold | |
| 6,729,089 | B1 | 5/2004 | Spragg | |
| 6,886,296 | B1 * | 5/2005 | John | E02D 5/60 248/519 |
| 7,850,148 | B2 * | 12/2010 | Collins, IV | E04H 12/2261 248/156 |

(Continued)

FOREIGN PATENT DOCUMENTS

WO WO2009021997 2/2009

*Primary Examiner* — Tan Le

(57) ABSTRACT

A wood support protection device for protecting wood supports from water damage includes a tube that defines an interior space. The tube has a top and a bottom. The top is open. The top is complementary to a lower end of a wood support. A plurality of rods is coupled to and extends substantially perpendicularly between opposing sides of the tube. A plurality of slots is positioned in the tube adjacent to the bottom. The top is configured to insert the lower end of the wood support into the interior space. The rods are configured to retain the wooden support above the bottom of the tube. The slots are positioned in the tube such that the slots are configured to drain water from the interior space. The wood support is protected from damage and rot caused by exposure of the lower end of the wood support to water.

17 Claims, 6 Drawing Sheets

(56) References Cited

U.S. PATENT DOCUMENTS

| | | | | |
|---|---|---|---|---|
| 8,133,049 | B1 | 3/2012 | Sullivan et al. | |
| 8,240,097 | B2 * | 8/2012 | Day | E02D 19/00 248/346.5 |
| 2007/0158526 | A1 * | 7/2007 | Platt | E04H 12/2284 248/519 |

* cited by examiner

WOOD SUPPORT PROTECTION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to protection devices and more particularly pertains to a new protection device for protecting wood supports from water damage.

BRIEF SUMMARY OF THE INVENTION

An embodiment of the disclosure meets the needs presented above by generally comprising a tube that defines an interior space. The tube has a top and a bottom. The top is open. The top is complementary to a lower end of a wood support. A plurality of rods is coupled to and extends substantially perpendicularly between opposing sides of the tube. A plurality of slots is positioned in the tube adjacent to the bottom. The top is configured to insert the lower end of the wood support into the interior space. The rods are configured to retain the wooden support above the bottom of the tube. The slots are positioned in the tube such that the slots are configured to drain water from the interior space. The wood support is protected from damage and rot caused by exposure of the lower end of the wood support to water.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
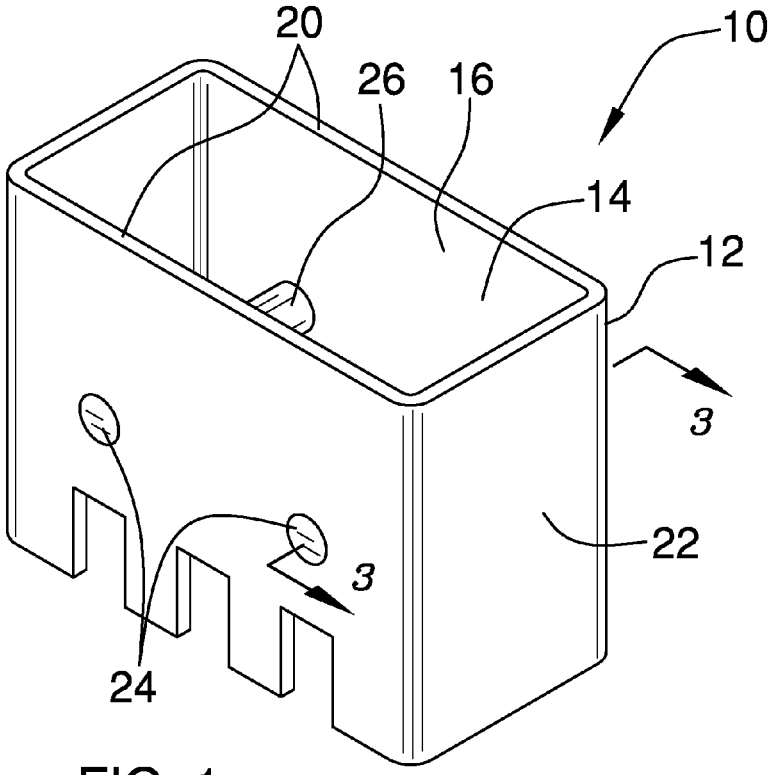
FIG. 1 is an isometric perspective view of a wood support protection device according to an embodiment of the disclosure.
Figure 2:
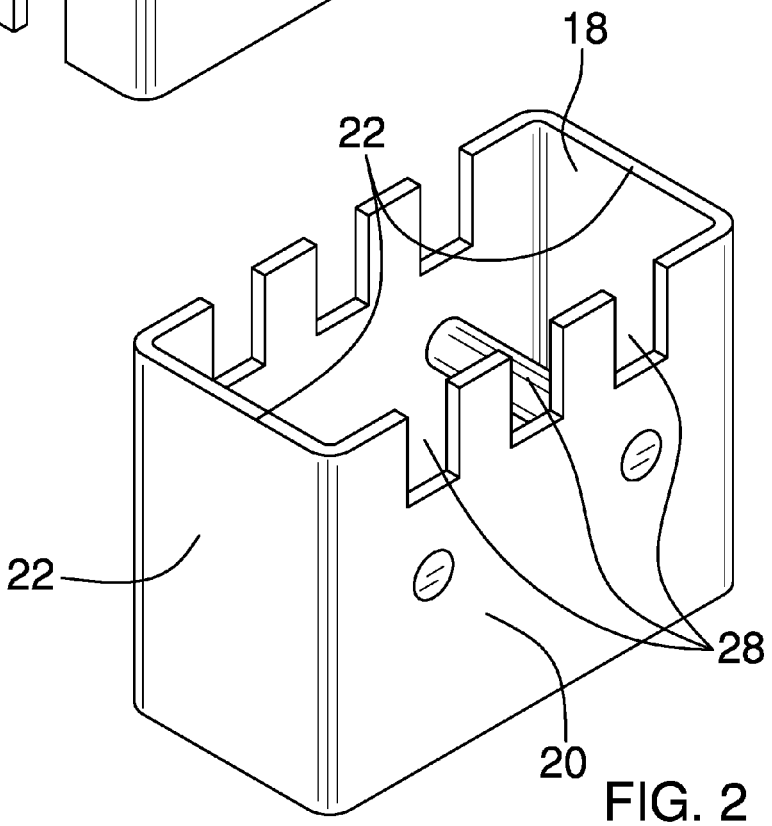
FIG. 2 is an isometric perspective view of an embodiment of the disclosure.
Figure 3:
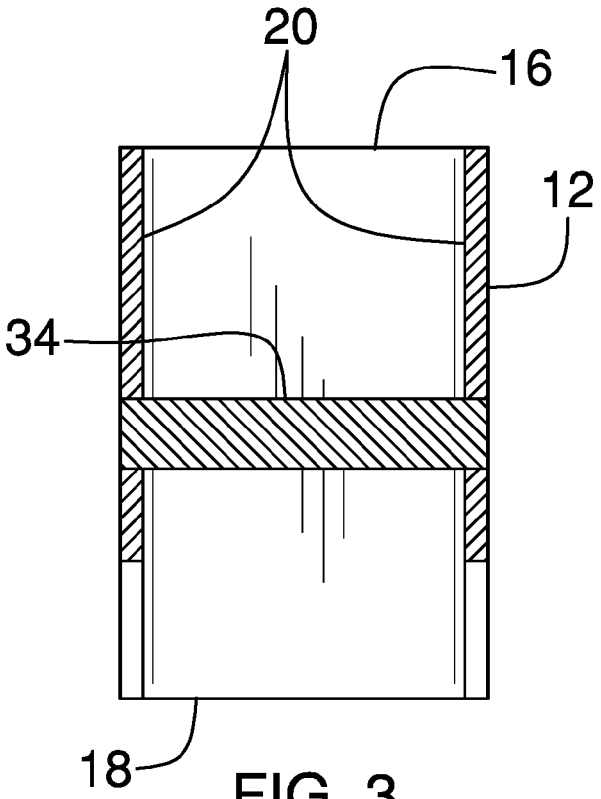
FIG. 3 is a cross-sectional view of an embodiment of the disclosure.
Figure 4:
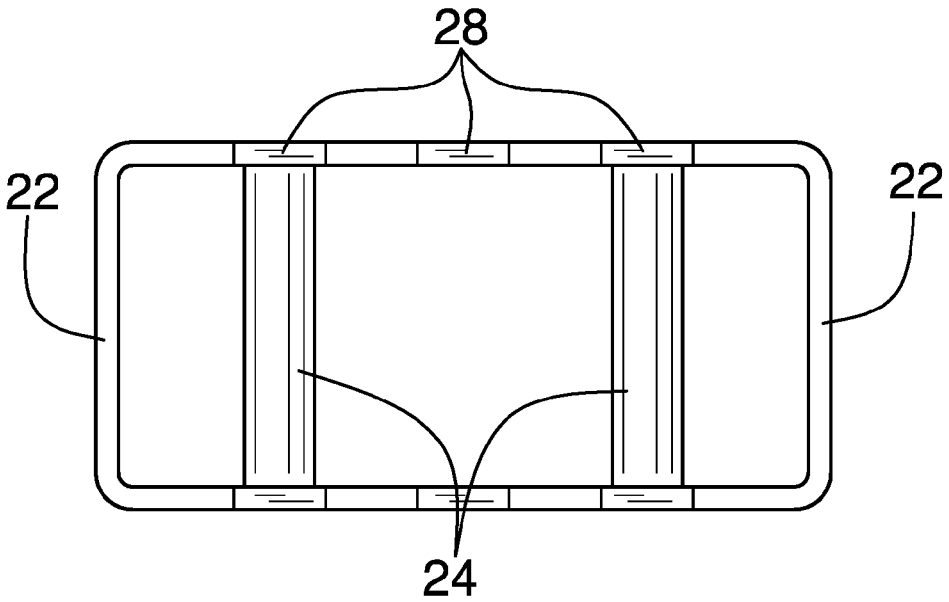
FIG. 4 is a bottom view of an embodiment of the disclosure.
Figure 5:
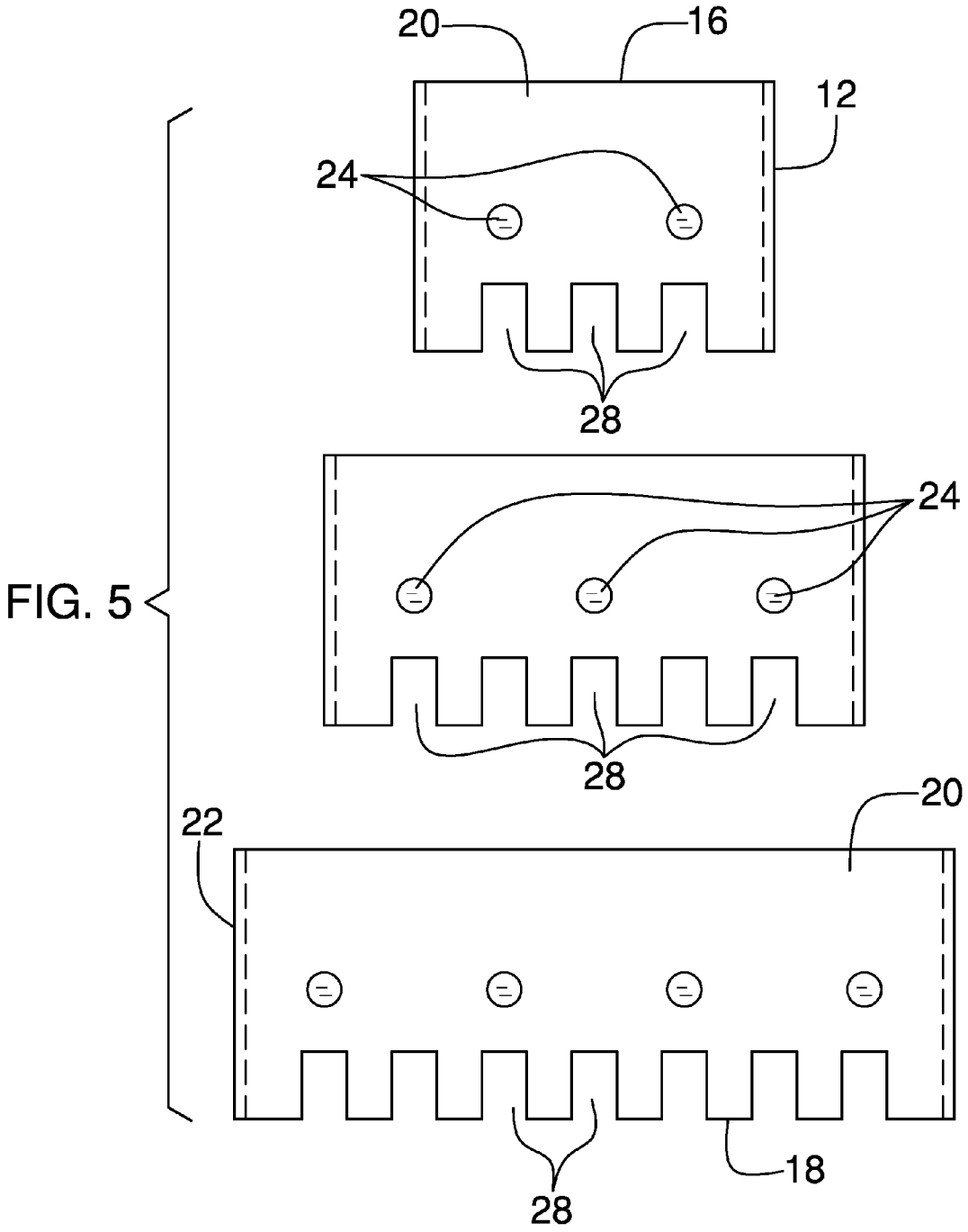
FIG. 5 is a side view of an embodiment of the disclosure.
Figure 6:
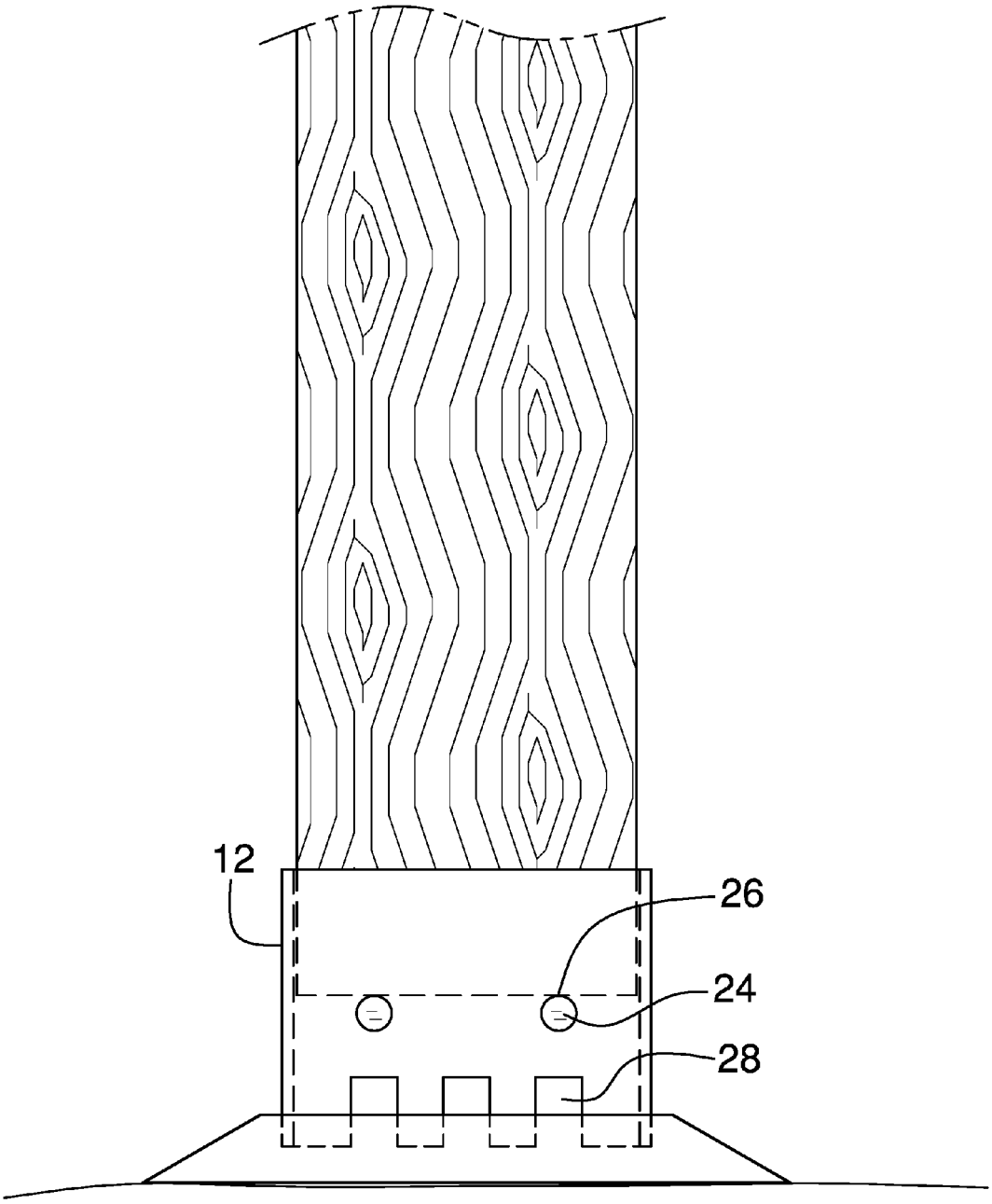
FIG. 6 is an in-use view of an embodiment of the disclosure.
Figure 7:
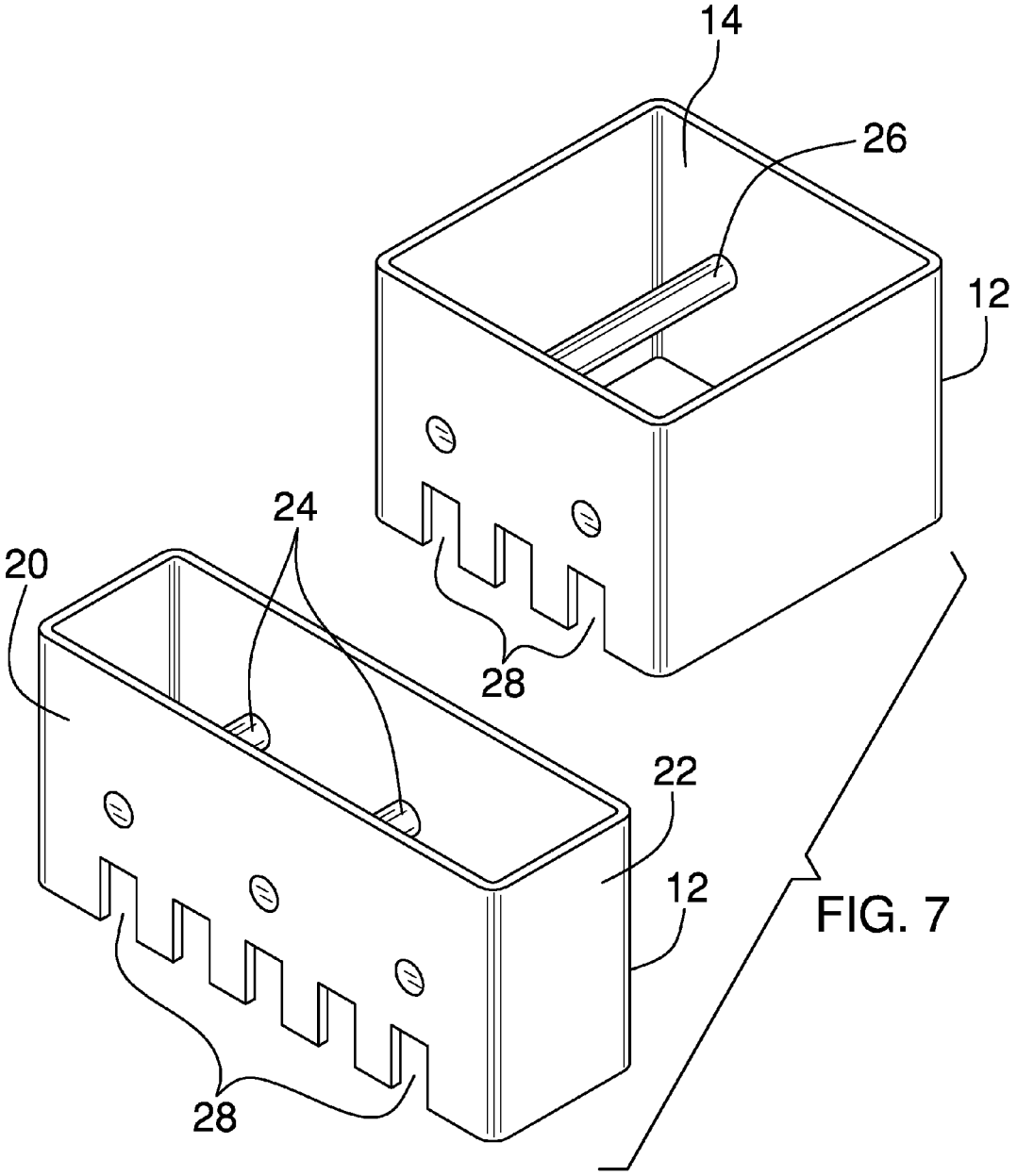
FIG. 7 is an isometric perspective view of an embodiment of the disclosure.
Figure 8:
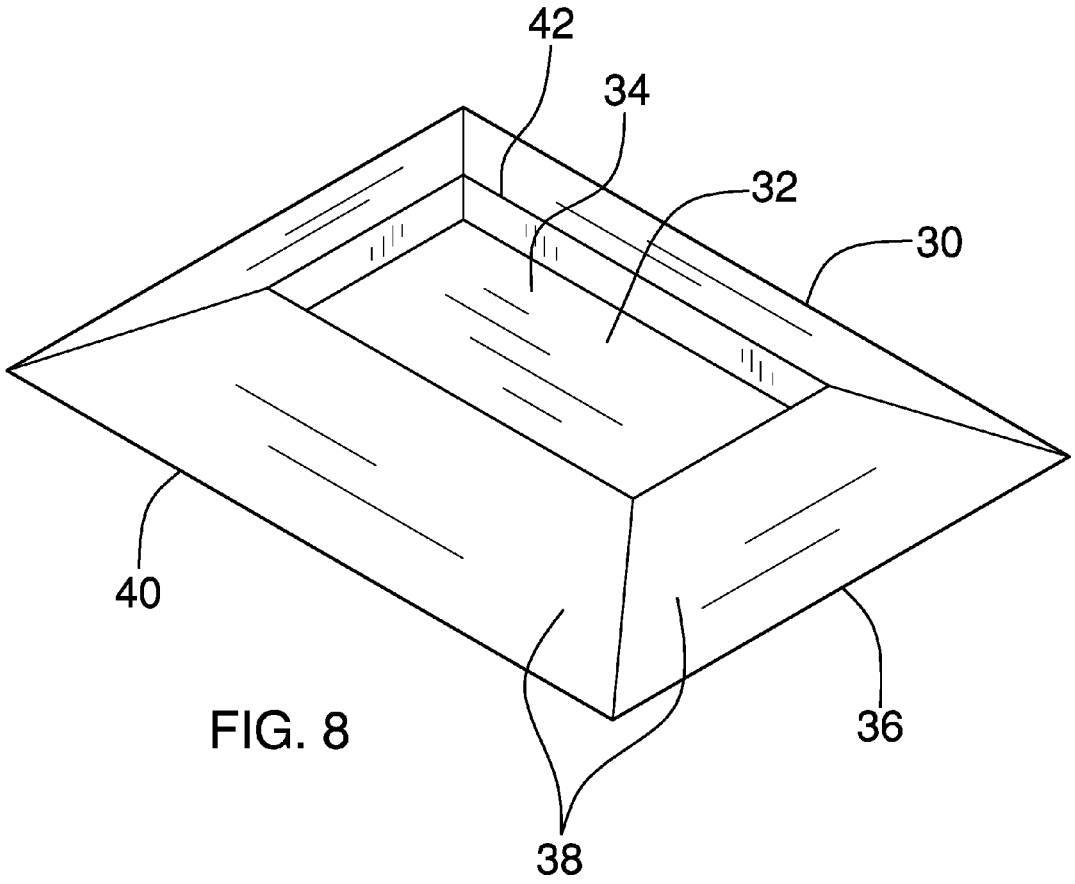
FIG. 8 is an isometric perspective view of an embodiment of the disclosure.

With reference now to the drawings, and in particular to FIGS. 1 through 8 thereof, a new protection device embodying the principles and concepts of an embodiment of the disclosure and generally designated by the reference numeral 10 will be described.

As best illustrated in FIGS. 1 through 8, the wood support protection device 10 generally comprises a tube 12 that defines an interior space 14. The tube 12 has a top 16 and a bottom 18. The top 16 is open. The top 16 is complementary to a lower end of a wood support. The top 16 is configured to insert the lower end of the wood support into the interior space 14. In one embodiment, the bottom 18 is open. In another embodiment, the top 16 and the bottom 18 are substantially dimensionally equivalent. In yet another embodiment, the top 16 is substantially rectangularly shaped.

The tube 12 has opposing sides 20 and opposing ends 22. In one embodiment, the opposing sides 20 are separated by from 19 to 286 millimeters and the opposing ends 22 are separated by from 19 to 286 millimeters. In another embodiment, the opposing sides 20 are separated by 38 millimeters and the opposing ends 22 are separated by 89 millimeters. In yet another embodiment, the opposing sides 20 are separated by 38 millimeters and the opposing ends 22 are separated by 140 millimeters. In still yet another embodiment, the opposing sides 20 are separated by 38 millimeters and the opposing ends 22 are separated by 184 millimeters. In still yet another embodiment, the opposing sides 20 are separated by 89 millimeters and the opposing ends 22 are separated by 89 millimeters.

A plurality of rods 24 is coupled to and extends substantially perpendicularly between the opposing sides 20 of the tube 12. The rods 24 are configured to retain the wooden support above the bottom 18 of the tube 12. In one embodiment, the rods 24 are positioned substantially equally distant from the top 16 and the bottom 18. Each rod 24 has an upper face 26. In one embodiment, the upper face 26 is rounded. In another embodiment, the rods 24 are circular when viewed longitudinally. In yet another embodiment, the plurality of rods 24 comprises from one to four rods 24.

A plurality of slots 28 is positioned in the tube 12 adjacent to the bottom 18. The slots 28 are positioned in the tube 12 such that the slots 28 are configured to drain water from the interior space 14. In one embodiment, the slots 28 are substantially rectangularly shaped. In another embodiment, the slots 28 are positioned in the opposing sides 20 of the tube 12. In yet another embodiment, the slots 28 are substantially evenly spaced between the opposing ends 22 of the tube 12. In still yet another embodiment, the plurality of slots 28 comprises from six to fourteen slots 28 evenly distributed in each of the opposing sides 20 of the tube 12.

In one embodiment, the device 10 comprises a base 30. The base 30 has a recess 32 that is positioned in an upper surface 34 of the base 30. The recess 32 is complementary to the bottom 18 of the tube 12. The recess 32 is positioned in the base 30 such that the recess 32 is positioned to insert the tube 12. The base 30 also comprises a lower surface 36 and an annular wall 38. In one embodiment, the upper surface 34 and the lower surface 36 are substantially rectangularly shaped. The annular wall 38 extends from a perimeter 40 of the lower surface 36 to a circumference 42 of the upper surface 34. The lower surface 36 is dimensionally larger than the upper surface 34, such that the annular wall 38 is tapered.

The present invention anticipates the tube 12 and the rods 24 comprising a metal, such as steel, a plastic, such as polyvinylchloride, or a combination of steel and plastic.

In use, the top 16 is configured to insert the lower end of the wood support into the interior space 14. The slots 28 are positioned in the tube 12 such that the slots 28 are configured to drain water from the interior space 14. The wood support is protected from damage and rot caused by exposure of the lower end of the wood support to water.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A wood support protection device comprising:

a tube defining an interior space, said tube having a top and a bottom, said top being open, said top being complementary to a lower end of a wood support;

a plurality of rods coupled to and extending substantially perpendicularly between opposing sides of said tube, said rods being positioned in a common plane parallel to said top and said bottom of said tube wherein said rods are configured for being positioned under and supporting the wood support, said rods being positioned substantially equally distant from said top and said bottom of said tube, each said rod having an upper face, said upper face being rounded; and a plurality of slots positioned in said tube adjacent to said bottom wherein said slots are configured for facilitating draining water from said tube.

2. The device of claim 1, further including said bottom being open.

3. The device of claim 1, further comprising:

said top and said bottom being substantially dimensionally equivalent; and said top being substantially rectangularly shaped.

4. The device of claim 3, further including said tube having opposing sides and opposing ends, said opposing sides being separated by from 19 to 286 millimeters, said opposing ends being separated by from 19 to 286 millimeters.

5. The device of claim 4, further comprising:

said opposing sides being separated by 38 millimeters; and said opposing ends being separated by 89 millimeters.

6. The device of claim 4, further comprising:

said opposing sides being separated by 38 millimeters; and said opposing ends being separated by 140 millimeters.

7. The device of claim 4, further comprising:

said opposing sides being separated by 38 millimeters; and said opposing ends being separated by 184 millimeters.

8. The device of claim 4, further comprising:

said opposing sides being separated by 89 millimeters; and said opposing ends being separated by 89 millimeters.

9. The device of claim 1, further including said rods being circular when viewed longitudinally.

10. The device of claim 1, further comprising:

said slots being substantially rectangularly shaped;

said slots being positioned in said opposing sides of said tube; and said slots being substantially evenly spaced between opposing ends of said tube.

11. The device of claim 10, further including said plurality of slots comprising from six to fourteen said slots evenly distributed in each of said opposing sides of said tube.

12. The device of claim 1, further including a base, said base having a recess positioned in an upper surface of said base, said recess being complementary to said bottom of said tube, wherein said recess is positioned in said base such that said recess is positioned for insertion of said tube.

13. The device of claim 12, further including said base comprising:

a lower surface, said upper surface and said lower surface being substantially rectangularly shaped;

an annular wall extending from a perimeter of said lower surface to a circumference of said upper surface; and said lower surface being dimensionally larger than said upper surface, such that said annular wall is tapered.

14. A wood support protection device comprising:

a tube defining an interior space, said tube having a top and a bottom, said top being open, said top being complementary to a lower end of a wood support, wherein said top is configured for insertion of the lower end of the wood support into said interior space, said bottom being open, said top and said bottom being substantially dimensionally equivalent, said top being substantially rectangularly shaped, said tube having opposing sides and opposing ends, said opposing sides being separated by from 19 to 286 millimeters;

a plurality of rods coupled to and extending substantially perpendicularly between said opposing sides of said tube, said rods being positioned in a common plane parallel to said top and said bottom of said tube wherein said rods are configured for being positioned under and supporting the wood support, said rods being positioned substantially equally distant from said top and said bottom, each said rod having an upper face, said upper face being rounded, said rods being circular when viewed longitudinally;

a plurality of slots positioned in said tube adjacent to said bottom, wherein said slots are positioned in said tube such that said slots are configured for water to drain from said interior space, said slots being substantially rectangularly shaped, said slots being positioned in said opposing sides of said tube, said slots being substantially evenly spaced between said opposing ends of said tube, said plurality of slots comprising from six to fourteen said slots evenly distributed in each of said opposing sides of said tube;

a base, said base having a recess positioned in an upper surface of said base, said recess being complementary to said bottom of said tube, wherein said recess is positioned in said base such that said recess is positioned for insertion of said tube, said base comprising:

a lower surface, said upper surface and said lower surface being substantially rectangularly shaped, an annular wall extending from a perimeter of said lower surface to a circumference of said upper surface, and said lower surface being dimensionally larger than said upper surface, such that said annular wall is tapered; and wherein said top is configured for insertion of the lower end of the wood support into said interior space, wherein said slots are positioned in said tube such that said slots are configured to drain water from said interior space, such that the wood support is protected from damage and rot caused by exposure of the lower end of the wood support to water.

15. The device of claim 14, further comprising:

said opposing sides being separated by 38 millimeters; and said opposing ends being separated by 140 millimeters.

16. The device of claim 14, further comprising:

said opposing sides being separated by 38 millimeters; and said opposing ends being separated by 184 millimeters.

17. The device of claim 14, further comprising:

said opposing sides being separated by 89 millimeters; and said opposing ends being separated by 89 millimeters.

* * * * *